US005857136A

United States Patent [19]

Yoneda et al.

[11] Patent Number: 5,857,136

[45] Date of Patent: Jan. 5, 1999

[54] BELT TRANSPORT DEVICE AND BELT FIXING DEVICE

[75] Inventors: Satoru Yoneda, Toyohashi; Hideji Hayashi, Okazaki, both of Japan

[73] Assignee: Minolta Co., Ltd., Osaka, Japan

[21] Appl. No.: 968,577

[22] Filed: Nov. 13, 1997

[30] Foreign Application Priority Data

Nov. 14, 1996 [JP] Japan ..... 8-302573

[51] Int. Cl.[6] ..... G03G 15/20

[52] U.S. Cl. ..... 399/329; 198/835; 474/191

[58] Field of Search ..... 399/307, 329, 399/162, 165, 303, 302, 312; 474/190, 191, 161; 492/16–20, 28, 37; 198/835

[56] References Cited

U.S. PATENT DOCUMENTS

| | | | |
|---|---|---|---|
| 2,976,738 | 3/1961 | Bascom . | |
| 3,430,506 | 3/1969 | Stone . | |
| 3,711,912 | 1/1973 | Teske et al. . | |
| 4,426,757 | 1/1984 | Hourticolon et al. | 29/121.8 |
| 4,580,033 | 4/1986 | Sakurai | 219/216 |
| 4,964,203 | 10/1990 | Lioy et al. | 29/121.8 |
| 5,254,045 | 10/1993 | Takahashi et al. | 472/92 |

FOREIGN PATENT DOCUMENTS

| | | |
|---|---|---|
| 56-014275 | 2/1981 | Japan . |
| 05072926 | 3/1993 | Japan . |
| 05127551 | 5/1993 | Japan . |
| 05-278892 | 10/1993 | Japan . |

*Primary Examiner*—Robert Beatty
*Attorney, Agent, or Firm*—McDermott, Will & Emery

[57] ABSTRACT

A belt fixing device of a type gripping and transporting a recording member bearing an unfixed toner image between an endless belt and a back-up member to fuse the unfixed toner image on the surface of the recording member and comprising a fixing/drive roller, heating/driven roller heated by a heater, a heated endless belt wound around the drive roller and driven roller, and a back-up member pressed against the drive roller through the endless belt. The belt fixing member is capable of transporting a recording member so as to cause the least damage possible, e.g., wrinkling and the like, to the recording member, and precisely maintaining the belt transport speed and transport member transport speed at a predetermined speed so as to produce excellent fixed images. The drive roller has a surface layer of elastic material which is treated by a polishing process along the exterior and in a direction opposite the direction of powered rotation of the drive roller.

25 Claims, 4 Drawing Sheets

BELT TRANSPORT DEVICE AND BELT FIXING DEVICE

BACKGROUND OF THE INVENTION

1. Field of the Invention

The present invention broadly relates to a method of forming images and to a belt transport device including a drive roller and a belt wound around the drive roller, and a belt fixing device using a belt transport device, and further relates to a belt fixing device to fuse an unfixed toner image on a recording member bearing the unfixed toner image via heat and pressure in an image forming apparatus of an electrophotographic type.

2. Description of the Related Art

Belt transport devices are used in various technological fields today. For example, image forming apparatuses of the electrophotographic type such as copiers, printers and the like are provided with fixing devices to fuse an unfixed toner image on a recording member bearing the unfixed toner images under heat and pressure, and such fixing devices may use a belt transport device as the fixing device.

Belt fixing devices are provided with a fixing roller/drive roller heated by a heater, an endless belt wound around the rollers, and a back-up member (typically a back-up roller) pressing against the drive roller through the endless belt. Fixing devices of this type are advantageous compared to fixing devices having a construction providing a back-up roller disposed opposite a heating roller heated by a heater; the related advantages are described below.

Heating an unfixed toner image formed on the surface of a recording member starts when it is inserted between the fixing roller and the back-up roller without any preheating, such that the toner is inadequately heated on the recording member side, although a predetermined temperature on the surface side of the toner image is attained; thereby, making it difficult to achieve excellent toner image fusion. This tendency is particularly pronounced when toner images comprising cyan, magenta, yellow, and black are overlaid one over another on the surface of a recording member in color image forming apparatuses. When a belt fixing device is used, however, an unfixed toner image can be preheated before insertion at the fixing position by means of the heated belt extending upstream from the fixing position in the direction of the transport of the recording member, so as to achieve the desired toner fusion under heat and pressure.

Consideration has been given to elevating the fixing temperature without using a belt fixing device. However, when the fixing temperature is raised, molten toner readily adheres to the fixing roller causing offset. A sufficient application of a separation agent, such as silicone oil, or the like, must be applied to the fixing roller so as to prevent this offset. This leads to further disadvantages insofar as excessive application of the separation agent will cause the separation agent to be transferred to the recording member, thereby reducing the quality of the recording member. Therefore, simply elevating the fixing temperature is not a sufficient solution.

Through extensive investigation, the present inventors found several problems with conventional belt fixing devices.

In belt fixing devices used in image forming apparatuses of an electrophotographic type, a recording member must be smoothly transported during the fixing of a toner image so as to avoid disturbing and dislocating the unfixed toner image carried on the surface of the recording member, and therefore, the recording member must be transported at a predetermined speed. According to the research conducted by the present inventors, when an unfixed toner image is fused onto the surface of a relatively thick recording member such as, an envelope, the fixing pressure must be reduced to avoid causing wrinkles in the recording member. However, reducing the pressure adversely affects the fixing characteristics of the toner image. It was discovered that forming at least a surface layer of an elastic material on the fixing roller/drive roller and increasing the fixing nip width between the fixing roller/drive roller and the back-up member, produces excellent toner image fusion while reducing the fixing pressure to a particular degree.

However, if the surface layer of a fixing roller/drive roller is formed of an elastic material in a belt fixing device, the radius of the drive roller readily changes due to the soft irregularities of the surface layer and tearing off of protuberances of the surface layer, so as to make it difficult to maintain the belt transport speed at a predetermined speed. This ultimately causes the recording member transport speed to fluctuate so as to easily reduce the quality of the fixed image.

Although these disadvantages have been described in terms of belt fixing devices used in image forming apparatuses of an electrophotographic type, such disadvantages are not limited to belt fixing devices. Rather, such belt fixing devices running a belt at a predetermined speed with good precision and transporting a transport object with as little damage as possible to the object, are applicable to belt transport devices in general which grip and transport a transport object between an endless belt and back-up member and are provided with a drive roller, driven roller, endless belt wound around the drive roller and driven roller, and back-up member pressed against the drive roller through the endless belt.

SUMMARY OF THE INVENTION

An object of the present invention is to provide a method of forming images and a drive roller used in a belt transport device of a type gripping and transporting a transport object between an endless belt and a back-up member and comprising a drive roller, a driven roller, an endless belt wound around the drive roller and a driven roller, and a back-up member pressed against the drive roller through the endless belt. The drive roller being capable of transporting a transport object so as to cause the least damage possible to the transport object, and precisely maintain the belt transport speed at a predetermined speed.

Another object of the present invention is to provide a belt transport device of a type gripping and transporting a transport object between an endless belt and a back-up member and comprising a drive roller, a driven roller, an endless belt wound around the drive roller and driven roller, and a back-up member pressed against the drive roller through the endless belt. The belt transport device being capable of transporting a transport object so as to cause the least damage possible to the transport object, and precisely maintain the belt transport speed and the transport object transport speed at a predetermined speed.

Still another object of the present invention is to provide an image forming apparatus comprising a belt fixing device of a type gripping and transporting a recording member bearing an unfixed toner image between an endless belt and a back-up member to fuse the unfixed toner image on the surface of the recording member. The belt fixing device comprising a fixing roller/drive roller, heating roller/driven roller heated by a heater, a heated endless belt wound around the drive roller and driven roller, and a back-up member pressed against the drive roller through the endless belt. The belt fixing member being capable of transporting a recording member so as to cause the least damage possible, e.g., wrinkling and the like, to the recording member, and precisely maintain the belt transport speed and transport member transport speed at a predetermined speed so as to produce excellent fixed images.

In order to eliminate the previously described disadvantages, the present invention provides the drive roller, belt transport device, and belt fixing device described below.

(1) A drive roller for a belt transport device to transport a transport object by gripping the transport object between an endless belt and a back-up member, the drive roller comprising a drive roller, driven roller, endless belt wound around the rollers, and back-up member pressed against the drive roller through the endless belt, wherein at least the surface layer of the drive roller is formed of an elastic material treated by a polishing process along the exterior surface thereof in a direction opposite the direction of powered rotation of the roller to allow transport of the belt. (2) A belt transport device to transport a transport object by gripping the transport object between the an endless belt and a back-up member, the belt transport device comprising a drive roller, driven roller, endless belt wound around the rollers, and back-up member pressed against the drive roller through the endless belt, wherein at least the surface layer of the drive roller is formed of an elastic material treated by a polishing process along the exterior surface thereof in a direction opposite the direction of powered rotation of the roller to allow transport of the belt. (3) A belt fixing device to fuse an unfixed toner image on a recording bearing an unfixed toner image by transporting the member between an endless belt and a back-up member, the belt fixing device comprising a fixing roller drive roller, a driven heating roller heated by a heater, and a heated endless belt wound around the drive roller and the driven roller, wherein at least the surface layer of the drive roller is formed of an elastic material treated by a polishing process along the exterior surface thereof in a direction opposite the direction of powered rotation of the roller to allow transport of the belt.

Since the drive roller, belt transport device, and belt fixing device of the present invention provide the drive roller with a surface layer formed of an elastic material, a wide nip width can be provided between the back-up roller and the part of the belt wrapped around the roller, so as to relatively reduce the pressure force exerted at the nip region when transporting a transport object and thus minimize damage to the transport object. Furthermore, the belt fixing device is capable of accomplishing the fixing process while preventing wrinkling of the recording member without adversely affecting the fixing characteristics of the toner image.

Although the surface layer of the drive roller is formed of an elastic material, this surface layer is treated by a polishing process along the exterior surface of the layer in a direction opposite the direction of rotation of the drive roller to allow for belt transport. This process eliminates beforehand areas readily detached by tearing, and protuberances which cause variation in the exterior diameter of the roller which may possibly produce a temporary depression on the opposite side of a protrusion, suppresses variation of the exterior diameter of the drive roller during belt transport by regularizing and stabilizing the exterior diameter of the drive roller when in contact with the belt wound there around to allow for belt transport, so as to maintain the actual belt transport speed at a predetermined speed and smoothly transport a transport object at a predetermined speed. This belt fixing device is capable of producing excellent fixed images by preventing disruption and dislocation of the image.

Examples of useful materials for constructing the surface layer of the drive roller of the present invention include various types of rubber (e.g., silicone sponge rubber, silicone rubber, urethane rubber, chloroprene rubber, ethylene-propylene rubber, acrylonitrilbutadiene rubber, styrene-butadiene rubber and the like).

A back-up roller is used as a representative example of the back-up member of the belt transport device and belt fixing device of the present invention.

The surface hardness of the back-up member should be higher than the surface hardness of the drive roller to allow a predetermined nip width between the back-up member and drive roller through the belt, and in the case of a belt fixing device, to allow separation of a stiff recording member from the belt by balancing the deformation of the belt at the nip region caused by the recording member passing therethrough and the curvature of the belt produced in conjunction with the radius of the drive roller.

The invention itself, together with further objects and attendant advantages, will best be understood by reference to the following detailed description taken in conjunction with the accompanying drawings.

DETAILED DESCRIPTION OF THE INVENTION

The preferred embodiments of the present invention are described hereinafter with reference to the accompanying drawings.

Figure 1:
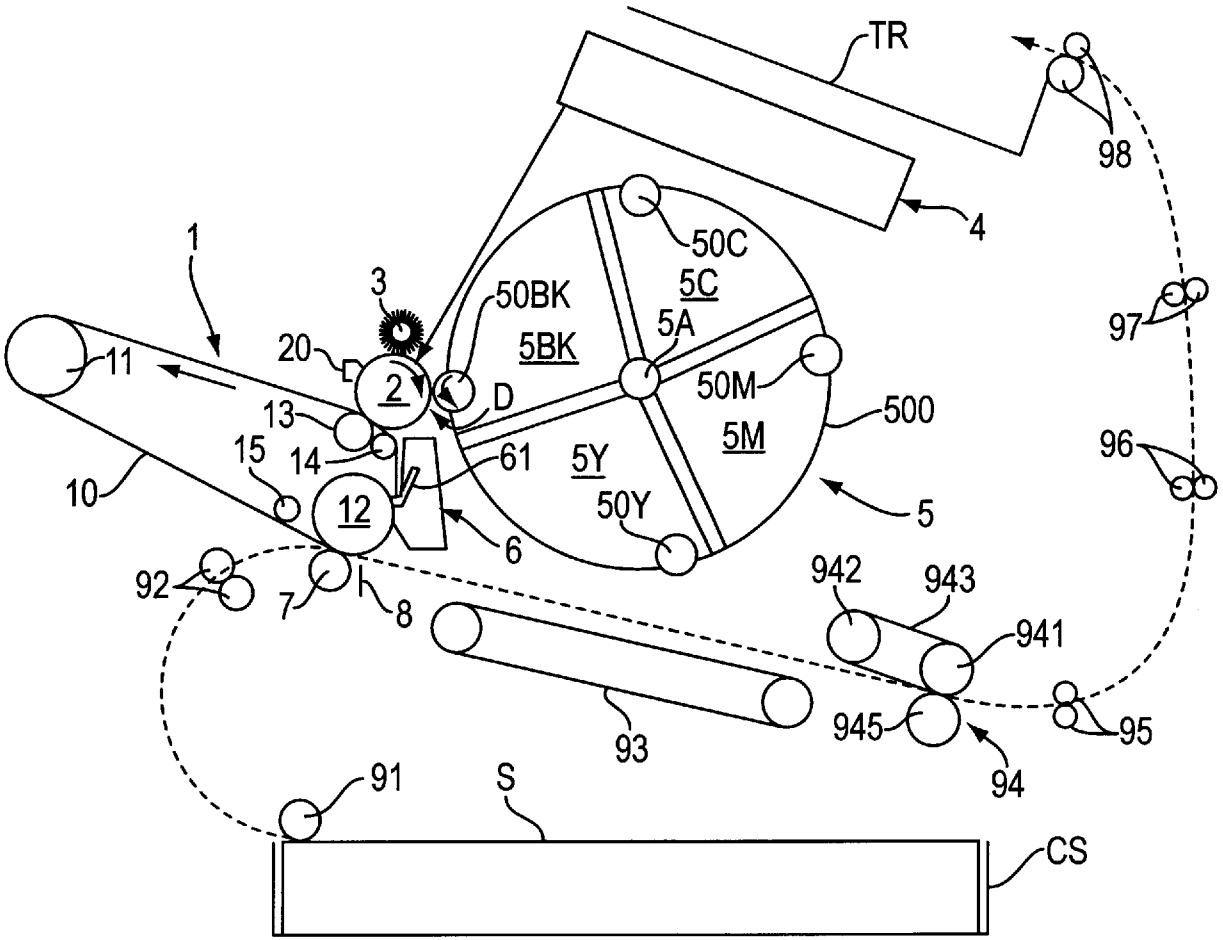
FIG. 1 briefly shows the construction of a full color laser printer provided with a belt fixing device of the present invention using a drive roller and belt transport device of the present invention.

FIG. 1 illustrates the construction of a full color laser beam printer provided with a belt fixing device 94 using a belt transport device provided with drive roller of the present invention. As best shown in FIG. 1, a printer comprises a photosensitive drum 2, which is rotatable in a clockwise direction in the drawing, a laser scanning unit 4, a full color developing unit 5, an intermediate transfer unit 1, having an endless-type intermediate transfer belt 10, a separation device 8, and a paper cassette CS. Arranged around the periphery of the photosensitive drum 2 is a charger 3 to uniformly charge the surface of the rotating photosensitive drum 2, the developing unit 5, the intermediate transfer unit 1, and a cleaner 20 to remove residual toner remaining on the surface of the photosensitive drum 2 after a primary transfer.

The laser scanning unit 4 includes well-known components such as a laser diode, polygonal mirror, fθ optical element and the like. Image data of the colors cyan(C), magenta(M), yellow(Y), and black(Bk) are output from a host device to a control unit (not illustrated) of the laser scanning unit 4. The laser scanning unit 4 emits a laser beam corresponding to the image data of each the colors to irradiate the surface of the photosensitive drum 2, between charger 3 and developing unit 5, so as to form an electrostatic latent image corresponding to each of the colors on the surface of the photosensitive drum 2.

The full color developing unit 5 is provided with color developing devices 5C, 5M, 5Y, and 5Bk respectively accommodating developers containing cyan(C), magenta (M), yellow(Y), and black(Bk) color toners, and mounted on a developing rack 500. The developing rack 500 pivots on a shaft 5*a* so as to be rotatable in a clockwise direction in the drawing. The color developing devices C, 5M, 5Y, and 5Bk are respectively provided with developing sleeves 50C, 50M, 50Y, and 50Bk. The developing unit 5 rotates, positioning the developing device of a corresponding color to a developing position D for each electrostatic latent image of the corresponding color formed on the surface of the photosensitive drum 2, to develop the electrostatic latent image of each color formed on the surface of photosensitive drum 2. In the present embodiment, the full color developing unit 5 is a rotary type unit to allow a more compact design of the printer overall.

The intermediate transfer belt 10 of the intermediate transfer unit 1 is wound around a drive roller 11, support roller 12, and tension rollers 14 and 15, and is driven in rotation in a counter clockwise direction, as illustrated, in synchronization with photosensitive drum 2. A projection (not illustrated) is provided at the side of the intermediate transfer belt 10 to control image forming operations, such as exposure, development, transfer and the like, by detecting the projection via a microswitch. The intermediate transfer belt 10 is pressed by a rotatably supported primary transfer roller 13 so as to be in contact with the photosensitive drum 2. This contact region is designated as the primary transfer region. A primary transfer voltage is provided by a power source, not shown, to the primary transfer roller 13.

A secondary transfer roller 7 makes pressure contact with the part of the intermediate transfer belt 10 supported by the support roller 12. This contact region is designated as the secondary transfer region. The secondary transfer roller 7 can be extended so as to come into pressure contact with intermediate transfer belt 10 and retracted so as to not be in contact with the intermediate transfer belt 10, as necessary via a mechanism not shown.

A transfer voltage from a power source, not shown, can be supplied to the secondary transfer roller 7, such that when a recording member passes between the intermediate transfer belt 10 and the secondary transfer roller 7 in contact therewith, the toner image formed on the intermediate transfer belt 10, in a manner described later, can be transferred to the recording member via the application of the aforesaid transfer voltage.

A cleaner 6 is arranged between the secondary transfer region and the primary transfer region in the direction of movement of the surface of intermediate transfer belt 10. Cleaner 6 is provided with a cleaning blade 61, and scrapes off the residual toner remaining on the surface of the intermediate transfer belt 10 via contact of the blade 61 in the region of the intermediate transfer belt 10 which is supported by the support roller 12. The cleaner 6 can bring the blade 61 into pressure contact with intermediate transfer belt 10, as well as retract the blade 61 so as to not be in contact with the intermediate transfer belt 10 as necessary, via a mechanism, not shown.

Recording sheets (i.e., transfer sheets) S that receive the transferred toner image are accommodated in paper cassette CS, and the stacked recording sheets S are fed one sheet at a time from cassette CS by a take-up roller 91. A pair of timing rollers 92 are disposed within the recording member transport path, as indicated by the dashed line in the drawing, to supply the recording sheet S to the secondary transfer region in synchronization with the toner image formed on the intermediate transfer belt 10. A separation device 8 is disposed on the downstream side of the secondary transfer region in the recording member transport path to separate the recording sheet S from the intermediate transfer belt 10. The separation device 8 comprises a discharge needle.

Provided on the downstream side from separation device 8 are a transport belt 93 to transport a separated recording sheet S to fixing device 94, which thermally fuses a toner image on the surface of recording sheet S, transport roller pairs 95, 96, and 97, and a pair of discharge rollers 98. A recording sheet S discharged by discharge rollers 98 is ejected onto discharge tray TR.

Figure 2:
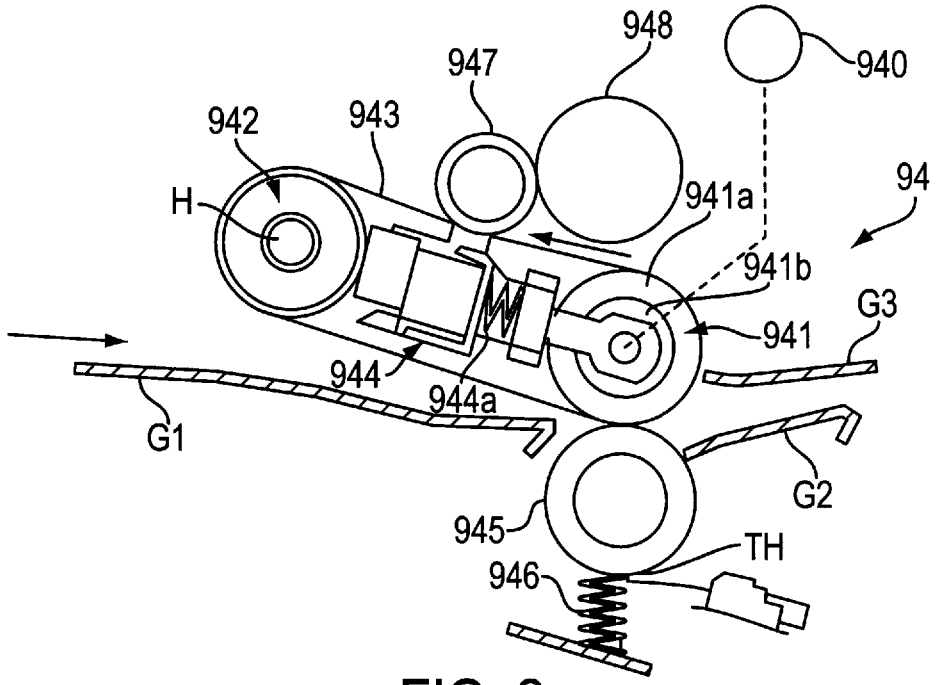
FIG. 2 shows details of the construction of the belt fixing device in the printer of FIG. 1.

As best shown in FIGS. 1 and 2, the fixing device 94 comprises a fixing roller/drive roller 941, a heating roller/driven roller 942 disposed a distance from the drive roller, a heating belt 943 of a flexible endless-type wound around the rollers, and a back-up roller 945 disposed adjacent to the drive roller 941 on the opposite side of the belt 943.

Figure 4A:
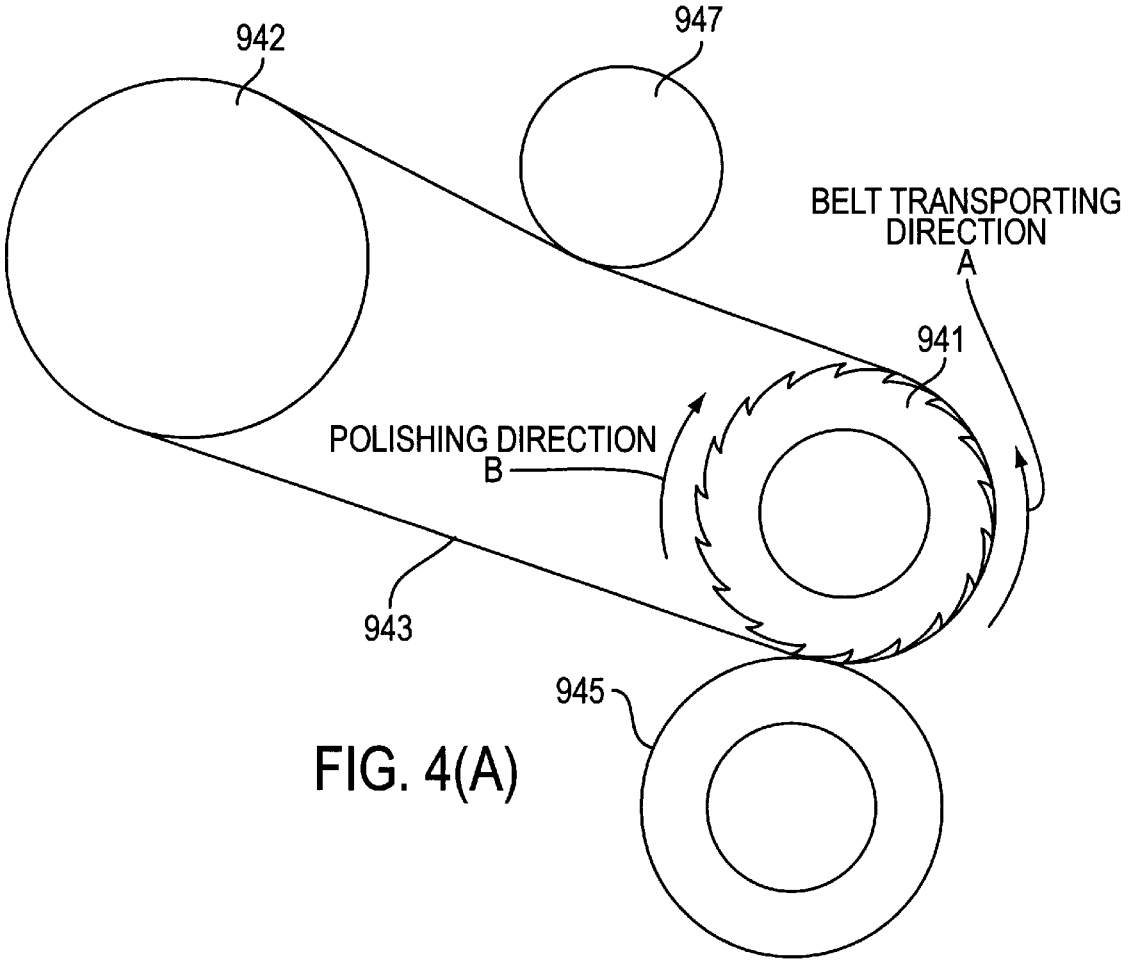
FIG. 4A is a side view of part of the belt transport device in the fixing device of FIG. 2.

The fixing roller/drive roller 941 is rotatably supported, not shown, on the housing of the fixing device and is powered for rotation in a counterclockwise direction as shown in FIG. 2 (i.e., the same direction as the belt transport direction A shown in FIG. 4A) via a motor 940. The heating roller/driven roller 942 has a built-in halogen lamp heater H, and is supported by the housing of the fixing device so as to be rotatable and extendible toward and retractable from the drive roller 941. A belt tension device 944, including a spring 944*a*, is provided between the drive roller 941 and the driven roller 942 to press the driven roller 942 in the retraction direction away from drive roller 941 under suitable pressure force so as to suitably expand the belt 943. The back-up roller 945 is supported by the housing of the fixing device so as to be rotatable and extendible toward and retractable from the drive roller, and is pushed from below by a spring 946 so as to be pressed against the part of the belt on the drive roller.

A separation agent application roller 947 is disposed in contact with belt 943 to apply silicone oil as a separation agent to prevent adhesion of molten toner on belt 943. A separation agent supply roller 948 is disposed in contact with the application roller 947. Reference numbers G1, G2, and G3 in FIG. 2 refer to recording member guide panels.

Figure 4B:
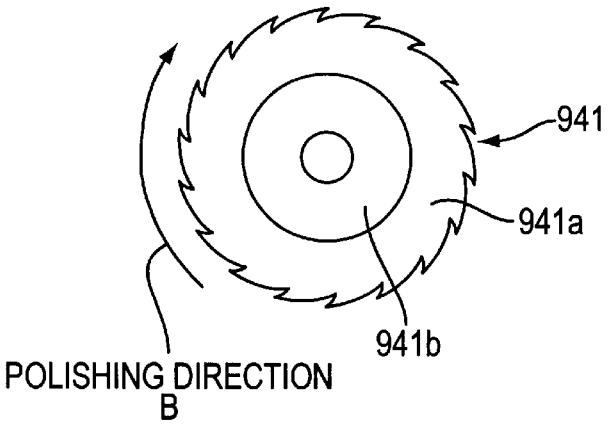
FIG. 4B is a side view of the drive roller.

The materials used to form the various components are described below. The fixing roller/drive roller 941 comprises a metal core roller 941*b* formed of sulfur-free composite cutting steel (SUM22) covered by a protective overcoat surface layer 941*a* of silicone sponge rubber (hardness: ASKER C30°), or the like. The silicone sponge rubber surface layer 941*a* is subjected before assembly to a polishing process along the exterior surface of the surface layer 941*a*. The rotation direction during the polishing process is opposite to the direction of powered rotation (i.e., direction B in FIG. 4A) which the roller exhibits for transporting the belt during normal operations. This polishing process is accomplished using a grindstone on an external cylindrical grinder, although not specifically restricted to the same. FIG. 4 shows the surface of the drive roller 941 with exaggerated material breakdown produced by the polishing process to facilitate understanding of the polishing direction.

The driven roller 942 is a metal roller formed of aluminum. Belt 943 has a dual-ply construction of nickel and silicone rubber. Back-up roller 945 is formed of silicone rubber and has a surface hardness greater than the surface hardness of the drive roller 941.

Next, the full color printing operation accomplished by the aforesaid full color printer is described below with reference to FIG. 1.

When the printing operation starts (first color image formation), the secondary transfer roller 7 and blade 61 of the cleaner 6 are separated from the intermediate transfer belt 10. The black developing device 5Bk is positioned at the developing position D. When the printing operation starts, the photosensitive drum 2 is powered in rotation in the clockwise direction, as shown in the drawing. Also, the intermediate transport belt 10 is powered to rotate at an identical circumferential speed as photo drum 2 and in a counterclockwise direction, as shown in the drawing, and photosensitive drum 2 is charged to a predetermined potential by the charger 3. A developing device selection operation starts in conjunction with the start of the printing operation, and yellow developing device 5Y is moved to the developing position D.

Then, a yellow image is optically exposed via the laser scanning unit 4 to form an electrostatic latent image of the yellow image on the surface of photosensitive drum 2. This electrostatic latent image is directly developed by developing device 5Y, and the developed toner image is transferred to intermediate transfer belt 10 at the primary transfer region. After the primary transfer is completed, the magenta developing device 5M is switched to the developing position D, and exposure, development, and primary transfer is accomplished for a magenta image. Similarly, the cyan developing device 5C is switched to developing position D, and exposure, development, and primary transfer of the cyan image is accomplished. Finally, the black developing device 5Bk is switched to the developing position D, and exposure, development, and primary transfer of the black image is accomplished until the aforesaid toner images are overlaid one upon another on the intermediate transfer belt 10 via the primary transfers.

When the last primary transfer is completed, the secondary transfer roller 7 and blade 61 are pressed against intermediate transfer belt 10. At this time, a recording sheet S is transported to the secondary transfer region, and the overlaid toner images formed on intermediate transfer belt 10 are transferred onto the recording sheet S by a transfer voltage applied to secondary transfer roller 7. When this secondary transfer is completed, the secondary transfer roller 7 is separated from the intermediate transfer belt 10.

Residual toner which has not been transferred to the recording sheet and remains on the intermediate transfer belt 10 at the secondary transfer region is scraped off by blade 61 in preparation for a subsequent image formation. Blade 61 is thereafter separated from belt 10.

After passing the secondary transfer region, the recording sheet S is transported to the fixing device 94, and after the toner image is thermally fused thereon, the recording sheet S is ejected to discharge tray TR.

Figure 3:
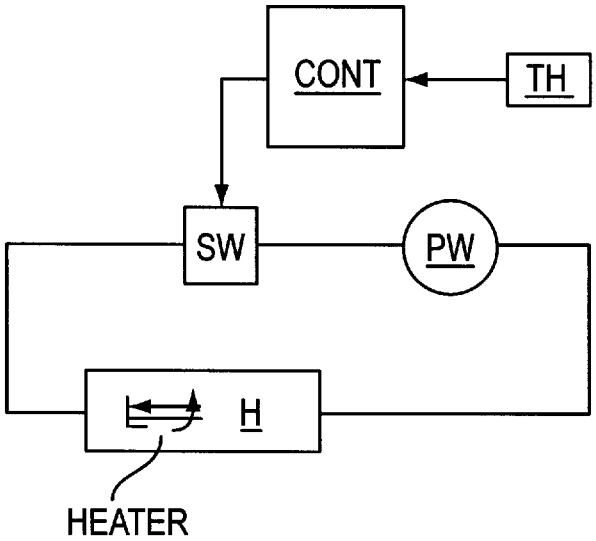
FIG. 3 is a block diagram of the control circuit of the halogen lamp heater in the fixing device of FIG. 2.

As best shown in FIGS. 2 and 3, in fixing device 94, the fixing temperature is controlled to fix the unfixed toner image. The temperature measured by a temperature sensor element (in this case, a thermistor TH), in contact with the back-up roller 945, is input to the temperature control unit CONT. Thereafter, a switching unit, including a heater power source PW, switch unit SW, and heater H, is controlled by instructions issued from the temperature control unit CONT based on the input temperature.

In the fixing unit 94, since the surface layer 941*a* of drive roller 941 comprises an elastic silicone sponge rubber and the surface hardness of the back-up roller 945 is greater than the surface hardness of the drive roller 941, the width of the fixing nip is wider in the recording member transport direction formed between the belt area on the drive roller 941 and the back-up roller 945, compared to conventional designs. Therefore, a recording member having, for example, a thickness such as an envelope, or the like, is smoothly transported through the wide nip under relatively low nip pressure which suppresses wrinkling and the like. The recording sheet S is then smoothly separated from the heating belt 943 while being transported, even without providing a special separation means such as separation member or the like. Furthermore, the fixing process can be accomplished without wrinkling of the recording member and without adversely affecting the toner image.

As best shown in FIGS. 4(*a*) and (*b*), the surface layer 941*a* of the drive roller 941 is formed of an elastic silicone sponge rubber, and this surface layer is subjected to a polishing process, prior to assembly, along the exterior surface of the surface layer in the direction B. The direction B is opposite the rotational direction A of the drive roller for the belt transport during normal operation of the apparatus. The polishing process eliminates areas readily detached by tearing and protuberances which cause variation in the exterior diameter of the roller which produces a temporary depression on the recording member, opposite the protrusion. The polishing process also suppresses variations of the exterior diameter of the drive roller during belt transport by regularizing and stabilizing the exterior diameter of the drive roller when in contact with the belt 943 wound there around. The regularizing and stabilizing maintains the actual belt transport speed at a predetermined speed and smoothly transports a recording member at a predetermined speed to produce excellent fixed images without disturbing or dislocating the image.

Experiments were conducted to investigate the dispersion of the transport speed of the heating belt 943. The experimental parameters are described below.

EXPERIMENT 1

The belt fixing device 94 described above in the preferred embodiment was used in the printer for experimental purposes.

EXPERIMENT 2

(Reference Example)

A belt fixing device was used having a drive roller 941 formed of identical materials used as the fixing roller/drive roller in the preferred embodiment of the belt fixing device 94, except that the surface layer was polished, using an identical grindstone, in an opposite direction, i.e., polished in the same direction as the rotational direction of the drive roller.

EXPERIMENT 3

A belt fixing device was used which had a drive roller 941 formed of identical materials used as the fixing roller/drive roller in the preferred embodiment of the belt fixing device 94, except that the surface of the drive roller was not treated by a polishing process.

In all of the experimental cases the surface temperature of the driven roller 942 was maintained at 175.

In all of the experimental cases the drive roller rotation was set at intermittent rotation of 30 sec rotation with repeated 1 sec stop intervals.

Figure 5:
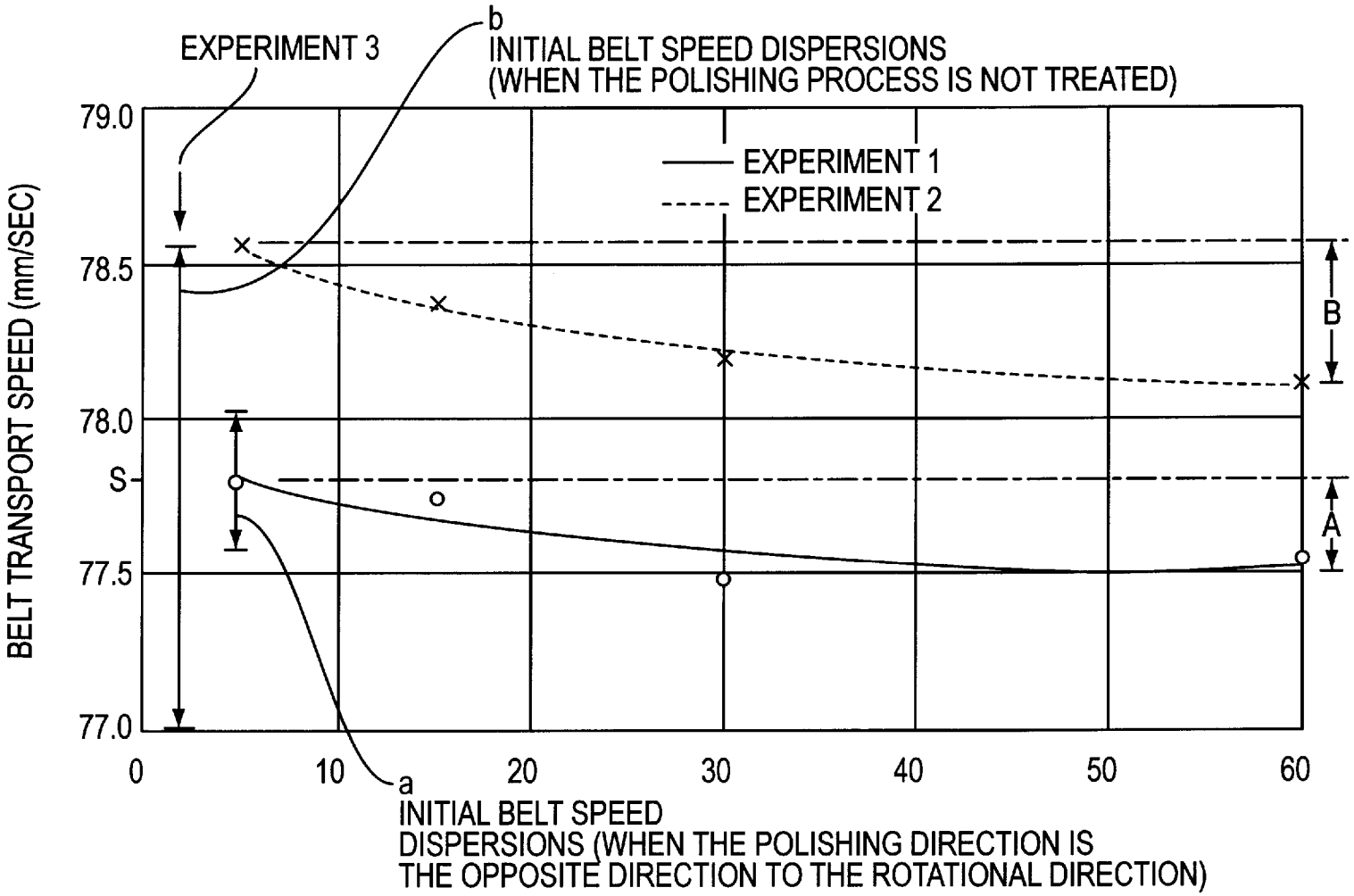
FIG. 5 illustrates the results of experiments investigating the relationship between the belt transport speed and the use of a polishing process on the surface of the drive roller, and the polishing direction when a polishing process is used.

The results of the experiments are shown in FIG. 5. The experiments were repeated numerous times with: a fixing device using a drive roller polished in the opposite direction to the rotational direction of the drive roller (experiment 1); a fixing device using a drive roller polished in the same direction as the rotational direction of the drive roller (experiment 2); and a fixing device using a drive roller which was not treated by a polishing process (experiment 3).

FIG. 5 illustrates the average state of the change over time of the belt transport speed for the fixing device using a drive roller polished in the opposite direction to the rotational direction of the drive roller (experiment 1), and the fixing device using a drive roller polished in the same direction as the rotational direction of the drive roller (experiment 2), at initial belt speed dispersions a and b, and the fixing device using a drive roller which was not treated by a polishing process (experiment 3). As can be understood from FIG. 5, comparing the change over time of the belt transport speed between the speed designated as A, when the polishing direction of the surface layer of the drive roller was the opposite direction to the rotational direction of the drive roller (i.e., belt transport direction), and the speed designated as B, when the polishing direction was the same as the rotational direction of the drive roller, it is clear that speed A is smaller than B. It can therefore be evident that polishing the surface layer in the opposite direction relative to the rotational direction of the drive roller produces a smaller dispersion of the belt transport speed over time. Furthermore, since the dispersion is also smaller when the polishing direction of the surface layer of the drive roller was the opposite direction to the rotational direction of the drive roller (i.e., belt transport direction) compared to when the surface of the drive roller was not treated by a polishing process (a<b), it is also evident that polishing of the drive roller surface layer as in the present invention is superior than not treating the surface with a polishing process.

Although the present invention has been described in terms of a belt fixing device using a belt transfer device with a belt drive roller in a color printer having an intermediate transfer member (i.e., intermediate transfer belt 10 in the aforesaid embodiments), variations on the embodiments described above are possible. For example, the belt fixing device of the present invention may also be used with color copiers, and so-called monochrome printers and copying machines. Furthermore, the drive roller of the present invention and the belt transport device of the present invention using the drive roller of the present invention may be used with other image forming apparatuses.

The embodiments described above provide a number of significant advantages. The present invent provides a drive roller applicable to a belt transport device of a type gripping and transporting a transport object between an endless belt and a back-up member and comprising a drive roller, driven roller, endless belt wound around the drive roller and driven roller, and a back-up member pressed against the drive roller through the endless belt. As a result, the drive roller is capable of transporting a transport object so as to cause the least damage possible to the transport object, and precisely maintain the belt transport speed at a predetermined speed.

Moreover, the present invention provides a belt transport device of a type gripping and transporting a transport object between an endless belt and a back-up member and comprising a drive roller, driven roller, endless belt wound around the drive roller and driven roller, and a back-up member pressed against the drive roller through the endless belt. The belt transport device is capable of transporting a transport object so as to cause the least damage possible to the transport object, and precisely maintain the belt transport speed and the transport object transport speed at a predetermined speed.

Finally, the present invention provides a belt fixing device of a type gripping and transporting a recording member bearing an unfixed toner image between an endless belt and a back-up member to fuse the unfixed toner image on the surface of the recording member and comprising a fixing roller/drive roll, heating roller/driven roller heated by a heater, a heated endless belt wound around the drive roller and driven roller, and a back-up member pressed against the drive roller through the endless belt. The belt fixing member is capable of transporting a recording member so as to cause the least damage possible, e.g., wrinkling and the like, to the recording member, and precisely maintaining the belt transport speed and transport member transport speed at a predetermined speed so as to produce excellent fixed images.

Of course, it should be understood that a wide range of changes and modifications can be made to the preferred embodiment described above. It is therefore intended that the foregoing detailed description be understood that it is the claims, including all equivalents, which are intended to define the scope of this invention.

What is claimed is:

1. A drive roller device for an image forming apparatus comprising:

a drive roller, driven roller and endless belt wound around said rollers, and a back-up member pressed against said drive roller through said endless belt; and a belt transport device to transport a transport object by gripping said transport object between said endless belt and said back-up member contacting said endless belt adjacent to said drive roller, the surface layer of said drive roller being formed of an elastic material treated by a polishing process along the exterior surface thereof in a direction opposite the direction of powered rotation of said drive roller to allow transport of said belt.

2. The drive roller device according to claim 1, wherein:

said endless belt being wound around said drive roller and said driven roller thereby forming a closed path around said rollers; and said drive roller rotates in the direction of powered rotation supplied by a power means for driving said endless belt.

3. The drive roller device according to claim 1, wherein said driven roller being heated by a heater disposed therein, and wherein said endless belt also being heated by said heater.

4. The drive roller device according to claim 2, further comprising:

a belt tension device including a spring provided between said drive roller and said driven roller for pressing said driven roller in the retraction direction away from said drive roller under suitable pressure forces, thereby expanding said endless belt.

5. The drive roller device according to claim 4, further comprising:

a spring adjacent to said back-up member applying compressive forces against said back-up member thereby pressing said back-up member in contact with said drive roller with endless belt there between, said compressive forces being adjusted for moving said back-up member toward or away from said drive roller to adjust contact forces between said endless belt, at the drive roller, and said back-up member.

6. The drive roller device according to claim 1, wherein:

said drive roller comprises a metal core roller including sulfur-free composite cutting steel; and said metal core being covered by the surface layer of said drive roller, wherein said elastic material of the surface layer comprises silicone sponge rubber.

7. The drive roller device according to claim 6, wherein said the polishing process along the exterior surface thereof being accomplished using an external grinder means.

8. The drive roller device according to claim 1, wherein:

said back-up member comprises a back-up roller formed of silicone rubber having a surface hardness greater than the surface hardness of said drive roller.

9. The drive roller device according to claim 1, further comprising:

a separation agent application roller disposed in contact with said endless belt, and applying a separation agent to said belt preventing adhesion of any residual toner existing on said belt; and a separation agent supply roller disposed in contact with said separation agent application roller, and applying separation agent to said separation agent application roller.

10. A belt transport device for an image forming apparatus to transport a transport object by gripping said transport object between an endless belt and a back-up member contacting said endless belt, said belt transport device comprising:

a drive roller, a driven roller and said endless belt wound around said rollers, and said back-up member pressed against said drive roller through said endless belt, the surface layer of said drive roller being formed of an elastic material treated by a polishing process along the exterior surface thereof in a direction opposite the direction of powered rotation of said drive roller to allow transport of said belt.

11. The belt transport device according to claim 10, wherein:

said endless belt being wound around said drive roller and said driven roller thereby forming a closed path around said rollers; and said drive roller rotates in the direction of powered rotation supplied by a power means for driving said endless belt.

12. The belt transport device according to claim 10, wherein said driven roller being heated by a heater disposed therein, and wherein said endless belt also being heated by said heater.

13. The belt transport device according to claim 11, further comprising:

a belt tension device including a spring provided between said drive roller and said driven roller for pressing said driven roller in the retraction direction away from said drive roller under suitable pressure forces, thereby expanding said endless belt.

14. The belt transport device according to claim 13, further comprising:

a spring adjacent to said back-up member applying compressive forces against said back-up member thereby pressing said back-up member in contact with said drive roller with endless belt there between, said compressive forces being adjusted for moving said back-up member toward or away from said drive roller to adjust contact forces between said endless belt, at the drive roller, and said back-up member.

15. The belt transport device according to claim 10, wherein:

said drive roller comprises a metal core roller including sulfur-free composite cutting steel; and said metal core being covered by the surface layer of said drive roller, wherein said elastic material of the surface layer comprises silicone sponge rubber.

16. The belt transport device according to claim 15, wherein said the polishing process along the exterior surface thereof being accomplished using an external grinder means.

17. The belt transport device according to claim 10, wherein:

said back-up member comprises a back-up roller formed of silicone rubber having a surface hardness greater than the surface hardness of said drive roller.

18. An image forming device for forming images on a recording member comprising a belt fixing device for fusing an unfixed toner image on the recording member by transporting the recording member bearing an unfixed toner between a endless belt and a back-up member, said belt fixing device comprising:

a fixing/drive roller, a driven roller heated by a heating means, and a heated endless belt wound around said fixing/drive roller and said driven roller, and wherein said endless belt is heated by said heating means, the surface layer of said fixing/drive roller being formed of an elastic material treated by a polishing process along the exterior surface thereof in a direction opposite the direction of powered rotation of said fixing/drive roller to allow transport of said belt.

19. The image forming device according to claim 18, further comprising:

a temperature controller means for controlling the temperature of said belt fixing device;

a temperature sensor element disposed in contact with said back-up member for detecting temperature of said belt fixing device in the vicinity of said back-up member, said heating means being controlled by said temperature controller means.

20. The image forming device according to claim 19, wherein:

said heating means comprises a switching device having a switch unit, power source, and heater, wherein said switching device being controlled by said temperature controller means.

21. The image forming device according to claim 18, wherein:

said back-up member comprises a back-up roller formed of silicone rubber having a surface hardness greater than the surface hardness of said fixing/drive roller.

22. A method of fixing an unfixed toner image on a recording medium for image-forming apparatuses, comprising the steps of:

driving an endless belt, wherein said endless belt being a close path wound around a drive roller and a driven roller, said drive roller driving said endless belt, wherein said drive roller rotates in the direction of powered rotation supplied by a power means for driving said endless belt;

pressing a backup member against said drive roller through said endless belt, wherein the surface layer of said drive roller being formed of an elastic material treated by a polishing process along the exterior surface thereof in a direction opposite the direction of powered rotation of said drive roller to allow transport of said belt; and transporting a transport object by gripping said transport object between said endless belt and said back-up member contacting said endless belt adjacent to said drive roller.

23. An drive roller used in a belt transport device which transports a transport object with rotation of an endless belt driven by said drive roller, said drive roller comprising:

a surface layer which is formed of an elastic material treated by a polishing process along the exterior surface thereof in a direction opposite the direction of rotation of the endless belt.

24. The drive roller as claimed in claim 23, further comprising a metal core which is covered by said surface layer.

25. The drive roller as claimed in claim 23, wherein said surface layer includes silicon sponge rubber.

* * * * *